United States Patent [19]

Zellweger et al.

[11] Patent Number: 4,859,174

[45] Date of Patent: Aug. 22, 1989

[54] DEVICE FOR IGNITING COMBUSTIBLE MATERIALS

[75] Inventors: Conrad Zellweger, Chene-Bougeries, Switzerland; Yves Gendey, Esery-Reignier, France

[73] Assignee: LN Industries S.A., Geneva, Switzerland

[21] Appl. No.: 208,495

[22] Filed: Jun. 20, 1988

[30] Foreign Application Priority Data

Jul. 10, 1987 [CH] Switzerland ..... 2633/87

[51] Int. Cl.[4] ..... F23Q 7/12

[52] U.S. Cl. ..... 431/255; 431/143; 431/344

[58] Field of Search ..... 431/142, 143, 254, 255, 431/256, 344, 89; 222/3, 402.25

[56] References Cited

U.S. PATENT DOCUMENTS

| | | | |
|---|---|---|---|
| 2,482,794 | 9/1949 | Peterson | 431/255 |
| 3,011,326 | 12/1961 | Fellner | 431/143 |
| 3,295,024 | 12/1966 | Newman | 431/143 |

FOREIGN PATENT DOCUMENTS

| | | |
|---|---|---|
| 2153583 | 5/1973 | France . |
| 2451002 | 10/1980 | France . |

*Primary Examiner*—Margaret A. Focarino
*Attorney, Agent, or Firm*—Young & Thompson

[57] ABSTRACT

The device comprises an upper part (1) including a combustion chamber (5) preceded by an air/gas mixing device (6). The lower part comprises a liquid gas reservoir (15), said reservoir being removable together with its injector (18). When replacing the empty reservoir with a filled one, the user benefits from an injector (18) in perfectly clean condition.

4 Claims, 1 Drawing Sheet

DEVICE FOR IGNITING COMBUSTIBLE MATERIALS

Devices for igniting combustible materials are already known, which comprise a body, a removable reservoir of liquefied gas, said reservoir being provided with a valve which controls the flow of the gas passing through a burner carried by said body, the latter comprising means for igniting the gas arriving at the burner and a member for operating said igniting means, said burner being of the type that comprises an air-gas mixing device followed by a combustion chamber provided with inlet passages for air in order to create an inflammable mixture. Amongst these known devices, there is, for example, the cigarette-lighter disclosed in the Peterson U.S. Pat. No. 2,482,794. The U.S. Pat. Nos. 2,464,007 and 4,534,482 describe devices which comprise some of the above-mentioned parts.

These devices need small flows of gas, a few grams per hour, and injection nozzles with holes generally smaller than the tenth of a milimeter. In certain cases, the holes may have a size of a few thousandths of a milimeter. The nozzles are normally formed of metallic membranes a few hundredths of a milimeter thick, in which a hole of the wanted size is made either by cutting or by laser ray piercing. Sometimes, watch jewels are also used. It is clear that such small size holes are easily blocked either by solid particles or by weakly volatile residues contained in the gas. In most cases the reservoir of these devices comprises a filling valve which can be connected to the beak of a recharging reservoir of a type presently largely available on the market. Most of these devices comprise a device for vaporizing the liquefied gas and which consists of a porous body, relatively flexible, compressed, restricting the flow of gas. This pressure reducer has a tendency to become warped if the compressed air used contains weakly volatile fractions which remain imprisoned in the porous mass. When the user chooses a gas comprising a much too large quantity of non-volatile fractions, the device is quickly out of use either as a result of the blockage of the holes in the injection nozzle or because of the warping of the pressure reducer, which generally means that the device must be returned for repair.

The aim of the present invention is to avoid these drawbacks.

To this effect and according to the invention, there is provided a device for igniting combustible materials, wherein said valve of said removable container has a part forming an injector for introducing the combustible gas into the chamber, said injector in its operating position facing an inlet conduit for bringing the gas into the chamber, an annular interval being provided between said injector and the inside wall of said inlet conduit, said valve comprising a compensation device to compensate for the temperature effect on the flow of the gas.

The attached drawing shows, diagrammatically and by way of example, an embodiment of the device which is the object of the invention.

Figure 1:
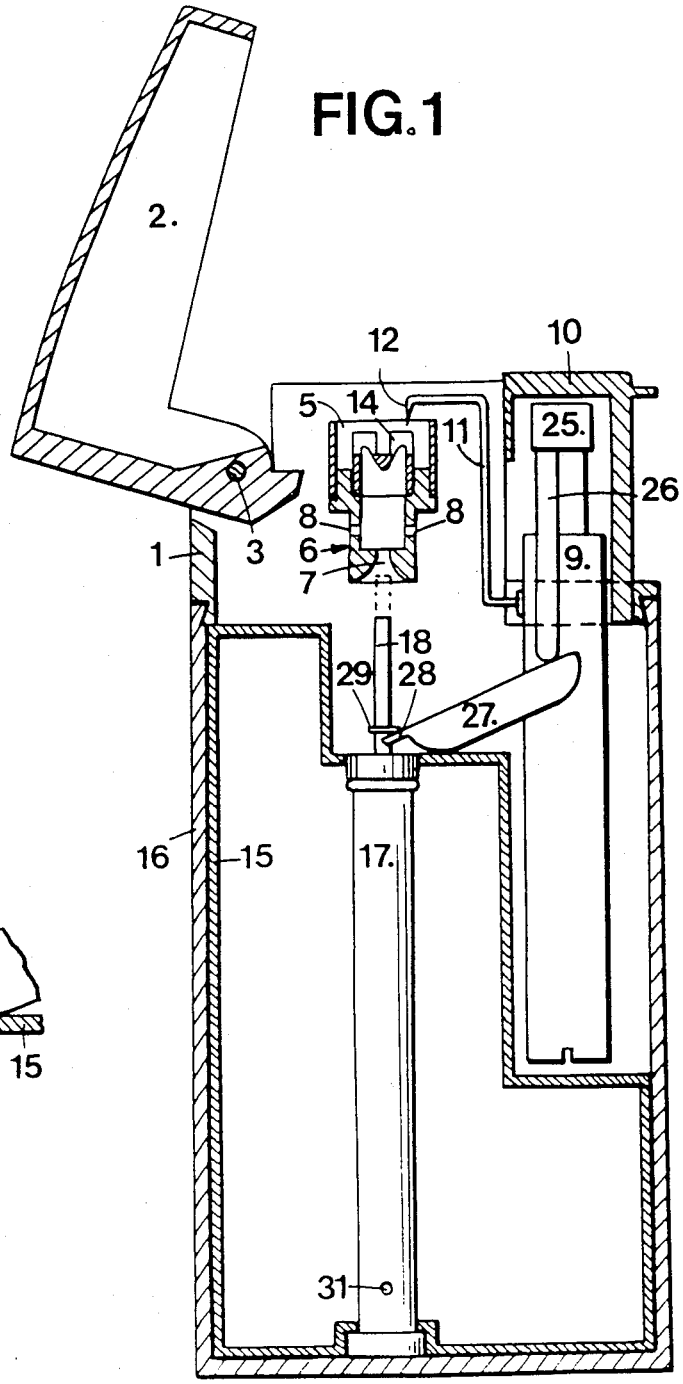
FIG. 1 is a vertical section view of said embodiment.

The device shown may be used as a cigarette-lighter or else as a lighter or igniter. It comprises an upper part 1 provided with a cover 2, articulated on a pin 3 and urged on by a spring device which is not shown in the figure because it is well-known in itself, said spring device being intended for elastically maintaining the cover in the closed position and, respectively, in the open position.

The upper part 1 also carries a combustion chamber 5 comprising an air-gas mixing device 6, attached to its base.

The air-gas mixing device comprises an inlet conduit 7 for the gas, this conduit being in a generally conical shape and having two lateral openings 8 forming additional inlets for air.

The upper part 1 further bears an electrical igniting device 9 of the piezoelectric type, which can be operated by a push-button 10. Since the piezoelectric igniting devices are well-known in themselves, this device will not be described in further detail. The igniting voltage is brought by a conductor 11 to an electrode 12 located in the chamber 5. The igniting spark bursts between said electrode 12 and a part of the chamber 5, for example, the winged diffusor 14 which ends the gas inlet conduit.

The device further comprises a reservoir 15 containing combustible liquefied gas, such as butane or propane or yet a mixture thereof. This reservoir 15 is held up by a cover 16 in notching engagement with the base of the upper part 1. The reservoir 15 is provided with a liquefied gas evaporator 17 which will be described in further detail with reference to FIG. 2. Said evaporator carries an injector 18 located facing the inlet conduit 7.

Figure 2:
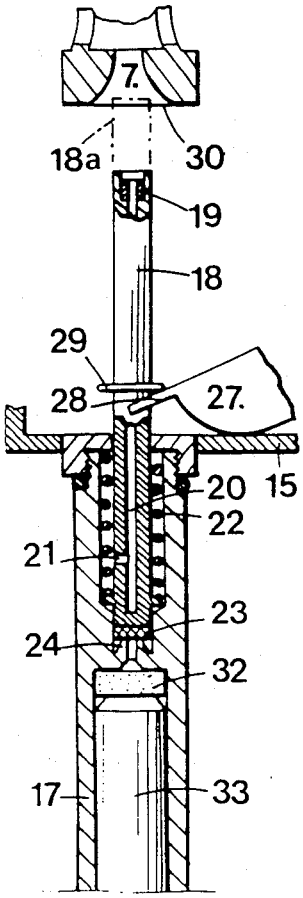
FIG. 2 is a section view, on a larger scale, of one part of the device.

With reference to FIG. 2, one can see that the injector ends in a part 19 provided with a gauged opening, said part being formed by a watch jewel which is pierced to form a nozzle. The boring of the jewel has a very small diameter, generally of the order of a few hundredths of a milimeter. The injector 18 is mobile and provided, in a known fashion, with a longitudinal boring 20 which communicates with a lateral boring 21. This injector is urged on by a spring 22 and carries on its base a stopping member 23, in elastomer, which is applied against a seat 24.

When the push-button 10 is operated on, a mobile part 25 of the piezoelectric device 9 is lowered and pushes one end of a rocking lever 27 by way of a finger 26, the other end 28 of the rocking lever being fork-shaped and engaged under a collar 29 of the injector 18. The lever 27 then assumes an horizontal position and its fork 28 lifts the injector 18 so as to open the valve formed by the stopping member 23 and the seat 24, thus allowing the injection of the gas into the mixing device.

The broken line **18*a* indicates the raised position of the injector 18 and it can be seen that this injector penetrates partially into the inlet conduit 7, so as to leave a free annular space 30 allowing a first air intake caused by the liquefied gas escaping through the opening in the watch jewel 19. Following this first air-gas mixing, the flux going out through the upper end of the conduit 7 provokes an additional intake of air through the openings 8, before the mixture penetrates in the combustion chamber 5**. The two components of the inflammable mixture must reach this combustion chamber with a well-determined mixture ratio in order that the combustion takes place inside the chamber, thus providing a flame with an excellent wind resistance.

In order to achieve the desired precision in the ratio of said two components, the flow or output of the combustible gas must be stable and protected from any variations in the vapor pressure of the liquefied gas. As is well-known, the vapor pressure is strongly dependent on the temperature. It is therefore advantageous to provide for a compensation device to compensate for the temperature effect, for example, a device such as the one disclosed in French patent No. 1,481,240.

In this type of device, the liquefied gas penetrates through an opening 31 of the evaporator 17 to reach a porous pellet 32 provided just under the seat 24. This pellet is compressed by a part 33 lodged in the evaporator 17, said part 33 having an expansion coefficient larger than that of the metallic tube forming the evaporator 17. This arrangement makes it possible to increase the pressure on the pellet 32 when the temperature of the liquefied gas in the reservoir 15 increases, thus compensating for the increase in the flow of gas which is due to the increase in the vapor pressure of the gas with the temperature.

As a result of the provided construction, the user may remove the reservoir, when it is empty or misfunctioning, by removing the cover 16, to replace the reservoir by a new one having the gauged opening of the injector in flawless condition, to ensure perfect operation of the device without interruption.

It is clear that many variants of construction may be foreseen and, in particular, that the injector 18 could face the inlet conduit 7 in the operating position, without penetrating partially in said conduit. The latter does not necessarily have to be conical and could as well be cylindrical, for example. Likewise, the additional air inlet through the lateral openings 8 is not indispensable and these openings could be omitted.

What is claimed is:

1. A device for igniting combustible materials, said device comprising a body, burner means comprising an air-gas mixing chamber, a combustion chamber at an upper end of said air-gas mixing chamber, means for igniting gas delivered to said combustion chamber, said air-gas mixing chamber including in a lower end thereof a gas inlet conduit opening into said chamber to permit delivery of gas to said air-gas mixing chamber, the diameter of said air-gas mixing chamber being greater than the diameter of the portion of said gas inlet conduit opening into said air-gas mixing chamber, a removable reservoir for liquefied gas, said reservoir being provided with valve means which controls the flow of gas from said reservoir, said valve means of said removable reservoir including tubular injector means having a bore of a diameter less than 0.1 mm, said tubular injector means adapted to deliver gas to said air-gas mixing chamber through said gas inlet conduit upon movement of said tubular injection means to a deliver position whereby a delivery end of said tubular injector means is axially displaced into a receiving end of said gas inlet conduit, an annular space being formed between said delivery end of said tubular injector means and the interior of the receiving end of said gas inlet conduit upon displacement of said tubular injector means to said delivery position, said annular space permitting air to be drawn into said gas inlet conduit together with said gas during delivery of same; and said valve means including means to compensate for the effect of temperature on the flow of said gas from said reservoir.

2. The device of claim 1 wherein said delivery end of said tubular injector includes a watch jewel through which said bore passes.

3. The device of claim 1 wherein said receiving end of said gas inlet conduit includes an opening having outwardly diverging surfaces.

4. The device of claim 3 wherein said air-gas mixing chamber includes at least one lateral air inlet for entry of air into said chamber, said lateral air inlet being positioned downstream of the portion of the gas inlet conduit opening into said air-gas mixing chamber.

* * * * *